US007034786B2

(12) United States Patent
Ham

(10) Patent No.: US 7,034,786 B2
(45) Date of Patent: Apr. 25, 2006

(54) COLOR-CORRECTION METHOD AND APPARATUS FOR LIQUID CRYSTAL DISPLAY

(75) Inventor: Yong Sung Ham, Kyounggi-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 29 days.

(21) Appl. No.: 10/015,896

(22) Filed: Dec. 17, 2001

(65) Prior Publication Data

US 2002/0196224 A1 Dec. 26, 2002

(30) Foreign Application Priority Data

Jun. 9, 2001 (KR) ..... 2001-32364

(51) Int. Cl.
*G09G 3/36* (2006.01)

(52) U.S. Cl. ..... 345/88; 345/89; 345/98; 345/204; 345/690

(58) Field of Classification Search ..... 345/87–104, 345/204–205, 690, 208–210
See application file for complete search history.

(56) References Cited

U.S. PATENT DOCUMENTS 5,465,102 A * 11/1995 Usui et al. ..... 345/89
5,495,265 A 2/1996 Hartman et al. ..... 345/87
5,828,367 A * 10/1998 Kuga ..... 345/211
5,920,300 A * 7/1999 Yamazaki et al. ..... 345/94
5,956,006 A * 9/1999 Sato ..... 345/88
6,329,980 B1 * 12/2001 Uehara et al. ..... 345/204
6,344,850 B1 * 2/2002 Okumura et al. ..... 345/204
6,414,657 B1 * 7/2002 Kasahara et al. ..... 345/63
6,501,451 B1 * 12/2002 Sakashita ..... 345/87
6,556,180 B1 * 4/2003 Furuhashi et al. ..... 345/87
2002/0024481 A1 * 2/2002 Kawabe et al. ..... 345/87
2002/0033813 A1 * 3/2002 Matsumura et al. ..... 345/204

FOREIGN PATENT DOCUMENTS

JP 7-56532 3/1995
WO WO99/05567 2/1999

* cited by examiner

*Primary Examiner*—Lun-yi Lao
(74) *Attorney, Agent, or Firm*—McKenna Long & Aldridge LLP

(57) ABSTRACT

The present invention discloses a color-correction method and apparatus for a liquid crystal display that effectively corrects a color balance. In the method and apparatus, input data are modulated to allow a high-speed driving. Also, a voltage level of the input data is reduced based on a modulated amount of the changed data when voltage level of the current frame is equal to that of the previous frame.

14 Claims, 9 Drawing Sheets

COLOR-CORRECTION METHOD AND APPARATUS FOR LIQUID CRYSTAL DISPLAY

This application claims the benefit of Korean Application No. P2001-32364 filed on Jun. 9, 2001, which is hereby incorporated by reference.

BACKGROUND OF THE INVENTION

1. Field of the Invention

The present invention relates to a liquid crystal display, and more particularly, to a color-correction method and apparatus for a liquid crystal display. Although the present invention is suitable for a wide scope of applications, it is particularly suitable for effectively correcting a color balance.

2. Discussion of the Related Art

Generally, a liquid crystal display (LCD) controls light transmittance of each liquid crystal cell in accordance with video signals, thereby displaying a picture. An active matrix LCD including a switching device for each liquid crystal cell is suitable for displaying a dynamic image. The active matrix LCD uses a thin film transistor (TFT) as a switching device.

However, the LCD has a disadvantage in a response time due to inherent characteristics of the liquid crystal such as viscosity and elasticity, etc.

Referring to FIG. 1, upon implementation of a moving picture, a conventional LCD cannot express desired color and brightness because one frame fails to achieve the target brightness when data are changed from one level to another level due to its slow response time. Accordingly, a motion-blurring phenomenon appears in the moving picture, and a display quality is deteriorated due to a reduction in a contrast ratio and hence a visual recognition by a user becomes poor.

In order to overcome such a slow response time in the LCD, U.S. Pat. No. 5,495,265 and PCT International Publication No. WO99/05567 have suggested a scheme for driving a liquid crystal display at a high speed using a look-up table for modulating a voltage of input data. This high-speed driving scheme modulates input data, as shown in FIG. 2.

Referring to FIG. 2, a conventional high-speed driving scheme modulates input data VD and applies the modulated data MVD to the liquid crystal cell, thereby obtaining desired brightness MBL. Accordingly, an LCD employing such a high-speed driving scheme reduces a motion-blurring phenomenon in a moving picture, thereby displaying a picture with desired color and brightness.

This high-speed driving scheme compares current input data with previous data to modulate the input data using look-up table information, as shown in Table 1.

TABLE 1

| | 3 V | 4 V | 5 V | 6 V | 7 V | 8 V |
|---|---|---|---|---|---|---|
| 3 V | | 6.6 V | 9.3 V | 11.8 V | 13.7 V | 15.4 V |
| 4 V | 2.2 V | | 6.8 V | 9.1 V | 11.2 V | 12.9 V |
| 5 V | 2.0 V | 3.2 V | | 7.3 V | 9.3 V | 11.1 V |
| 6 V | 1.65 V | 2.6 V | 4.0 V | | 8.0 V | 9.8 V |
| 7 V | 1.6 V | 2.6 V | 3.5 V | 4.9 V | | 8.8 V |
| 8 V | 1.6 V | 2.4 V | 3.1 V | 4.4 V | 6.2 V | |

In the above table, the furthermost left column is for a data voltage VDn−1 of the previous frame Fn−1 while the uppermost row is for a data voltage VDn of the current frame Fn.

According to Table 1, the look-up table information suggested in the conventional high-speed driving scheme modulates input data VD on the basis of a data voltage relationship between the previous frame Fn−1 and the following current frame Fn. The data voltage relationship is expressed by the following equations:

$$VDn<VDn-1 \rightarrow MVDn<VDn \quad (1)$$

$$VDn=VDn-1 \rightarrow MVDn=VDn \quad (2)$$

$$VDn>VDn-1 \rightarrow MVDn>VDn \quad (3)$$

In the above equations, VDn−1 represents a data voltage of the previous frame, VDn is a data voltage of the current frame, and MVDn represents a modulated data voltage.

As shown in Table 1 and equation (1), the conventional high-speed driving method is to compare the data voltage VDn−1 of the previous frame Fn−1 with the data voltage VDn of the current frame Fn. If the data voltage VDn inputted at the current frame Fn is smaller than the data voltage VDn−1 of the previous frame Fn−1 as a result of such a comparison, it is modulated to be smaller.

Further, from Table 1 and equations (2) and (3), the conventional high-speed driving method applies the input data voltage to the liquid crystal cell without a data modulation when the data voltage VDn inputted at the current frame Fn is equal to the data voltage VDn−1 of the previous frame Fn−1. On the other hand, the input data voltage is modulated to be greater when the data voltage VDn inputted at the current frame Fn is larger than the data voltage VDn−1 of the previous frame Fn−1.

However, the conventional high-speed driving method has a problem in that a color expression may be further distorted upon displaying colors.

A single dot includes sub-cells for expressing three primary colors of light, that is, red (R), green (G), and blue (B) colors. A color is determined by the sum of red, green, and blue lights emitted from the sub-cells.

If data are continuously changed between the previous frame Fn−1 and the current frame Fn as shown in a moving picture, a desired color cannot be expressed when sub-cells having a data value to be changed between frames and sub-cells having a data value to be unchanged between frames co-exist in one dot.

Referring to FIG. 3, red data VRD are modulated to be greater than an input data value at the previous frame Fn−1. They are not modulated when a data value of the current frame Fn becomes equal to that of the previous frame Fn−1. Green data VGD are modulated to be greater than the input data value at both the previous frame Fn−1 and the current frame Fn. On the other hand, blue data VBD are modulated to be greater than the input data value at the previous frame Fn−1 and modulated to be smaller than the previous frame Fn−1 at the current frame Fn. As mentioned above, unmodulated red data VRD are applied as input data to the liquid crystal cell, whereas the green data VGD and the blue data VBD are modulated and then applied to the liquid crystal cell.

As shown in FIG. 4, brightness BLG and BLB of the green sub-cell and the blue sub-cell appear to have a brightness level lower than a desired brightness level indicated by the oblique line portions at the current frame Fn due to a slow response characteristic of the liquid crystal.

Therefore, the picture has contrast lower than intended colors to display. On the other hand, brightness BLR of the red sub-cell maintains brightness of the previous frame Fn−1 at the current frame Fn. As a result, the conventional high-speed driving scheme may distort a color balance upon displaying colors due to a defective data modulation method.

SUMMARY OF THE INVENTION

Accordingly, the present invention is directed to a color-correction method and apparatus for a liquid crystal display that substantially obviates one or more of problems due to limitations and disadvantages of the related art.

Another object of the present invention is to provide a color-correction method and apparatus for a liquid crystal display for effectively correcting a color balance.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a color-correction method for a liquid crystal display includes increasing a data voltage of a current frame if the data voltage of the current frame is greater than that of a previous frame, and decreasing the data voltage of the current frame if the data voltage of the current frame is not greater than that of the previous frame.

In the color-correction method, the data is selected from most significant bit data. Alternatively, the data voltage includes both most significant bit data and least significant bit data.

In another aspect of the present invention, a color-correction method for a liquid crystal display includes decreasing a data voltage of a current frame if the data voltage of the current frame is the same as that of a previous frame, and increasing the decreased data voltage of the current frame if the decreased data voltage of the current frame is greater than that of the previous frame, and decreasing the decreased data voltage of the current frame if the decreased data voltage of the current frame is smaller than that of the previous frame.

In another aspect of the present invention, a color-correction apparatus for a liquid crystal display includes a frame memory delaying data for one frame interval, and a data modulator modulating the data from the frame memory using a look-up table having modulation information increasing a data voltage of a current frame if the data voltage of the current frame is greater than that of a previous frame, and decreasing the data voltage of the current frame if the data voltage of the current frame is not greater than that of the previous frame.

The color-correction apparatus further includes a liquid crystal display panel displaying modulated data by the data modulator, a timing controller outputting input data to the frame memory and the data modulator, a data driver applying the modulated data to the liquid crystal display panel under control of the timing controller, and a gate driver selecting a scanning line of the liquid crystal display panel to be supplied with the modulated data.

In another aspect of the present invention, a color-correction apparatus for a liquid crystal display includes a data comparator for determining whether input data are changed between a previous frame and the current frame, a first data modulator for increasing a voltage level of the input data when the voltage is more increased at the current frame than at the previous frame and for more decreasing the voltage level when the voltage level is more reduced at the current frame than at the previous frame, and a second data modulator for decreasing the voltage when the voltage the current frame is equal to that of the previous frame in accordance with a compared result from the data comparator.

The color-correction apparatus further includes a liquid crystal display panel for displaying modulated data by the first and second data modulators, a timing controller for outputting input data to the data comparator and the first and second data modulators, a data driver for applying-the modulated data to a data line of the liquid crystal display panel under control-of the timing controller, and a gate driver for selecting a scanning line of the liquid crystal display panel supplied with the modulated data under control of the timing controller.

In the color-correction apparatus, the data comparator includes an exclusive logical sum operator executing an exclusive logical sum operation of delayed data and current input data.

The first modulator includes a frame memory for delaying the input data for one frame interval, and a look-up table registered with modulation information for increasing a voltage level of the input data when the voltage level is more increased at the current frame than at the previous frame and decreasing the voltage of the input data when the voltage level is more reduced at the current frame than at the previous frame.

The second modulator includes a look-up table registered with modulation information for reducing the voltage level when the voltage level of the current frame is equal to that of the previous frame based on information from the data comparator.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings.

DETAILED DESCRIPTION OF THE ILLUSTRATED EMBODIMENTS

Reference will now be made in detail to the illustrated embodiments of the present invention, examples of which are illustrated in the accompanying drawings. Wherever possible, the. same reference numbers will be used throughout the drawings to refer to the same or like parts.

Figure 1:
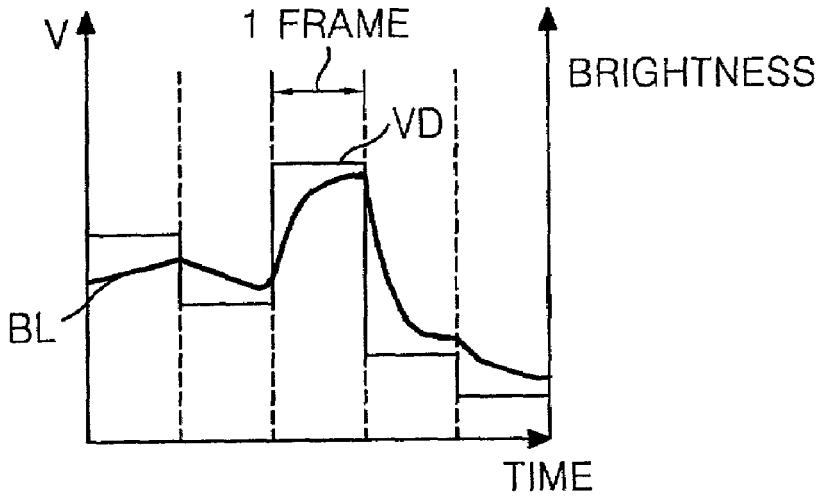
FIG. 1 CONVENTIONAL ART
FIG. 1 is a waveform diagram showing a brightness variation with respect to a data modulation in a conventional liquid crystal display.
Figure 2:
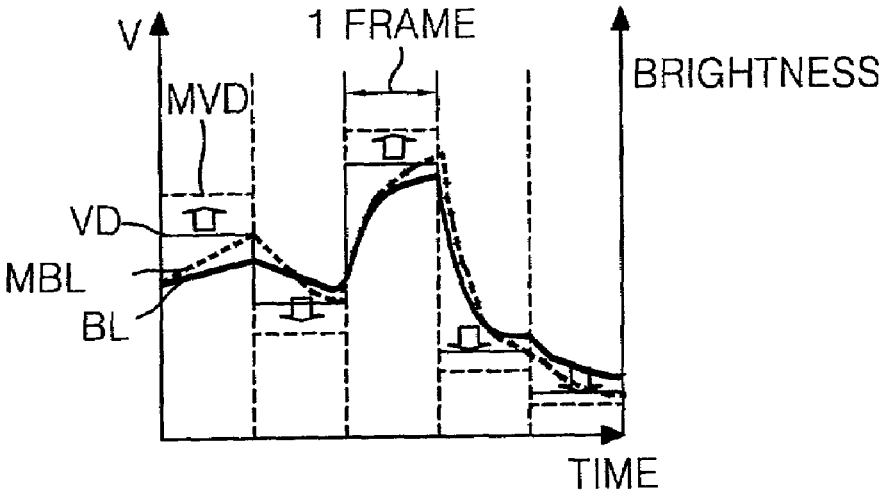
FIG. 2 CONVENTIONAL ART
FIG. 2 is a waveform diagram showing a brightness variation with respect to a data modulation using a conventional high-speed driving scheme.
Figure 3A:
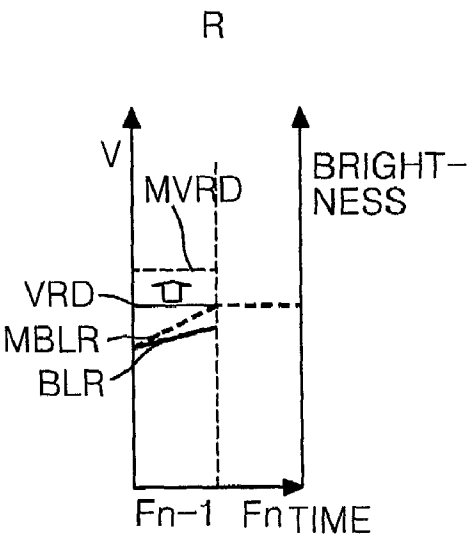
FIG.3A CONVENTIONAL ART
FIGS. 3A to 3C are waveform diagrams showing a brightness variation for R, G, and B pixels in the conventional high-speed driving scheme.
Figure 3B:
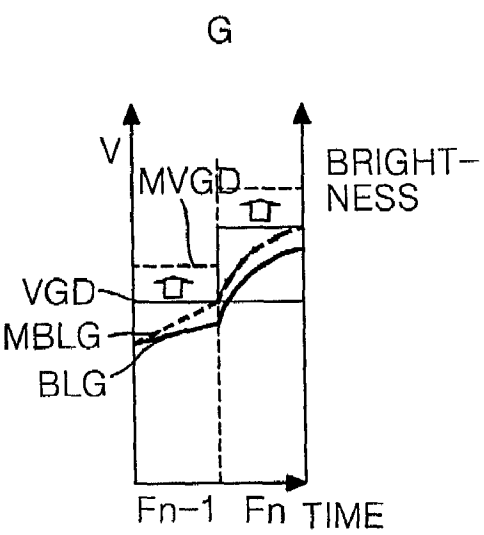
FIG.3B CONVENTIONAL ART
Figure 3C:
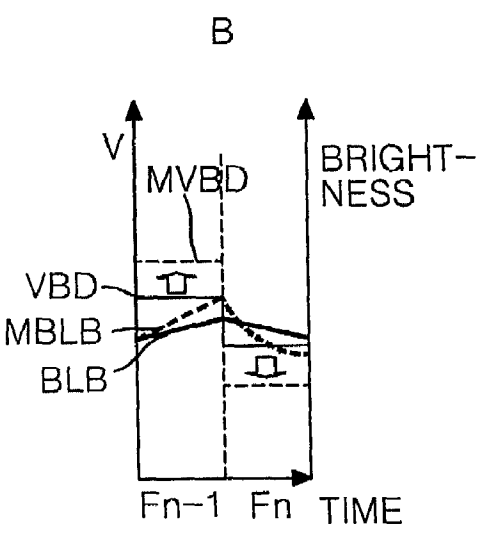
FIG.3C CONVENTIONAL ART
Figure 4A:
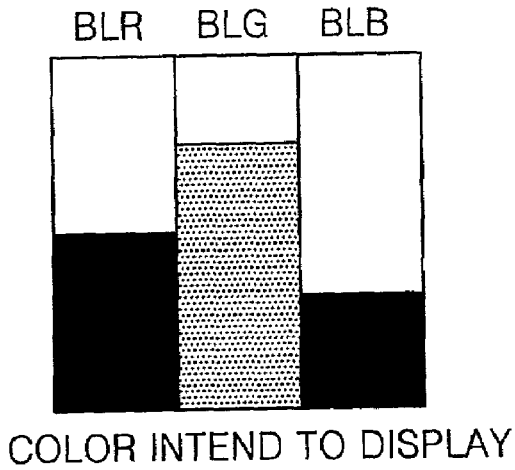
FIG.4A CONVENTIONAL ART
FIGS. 4A and 4B are schematic diagrams comparing colors intended to display with the colors displayed on a liquid crystal display panel in the conventional high-speed driving scheme.
Figure 4B:
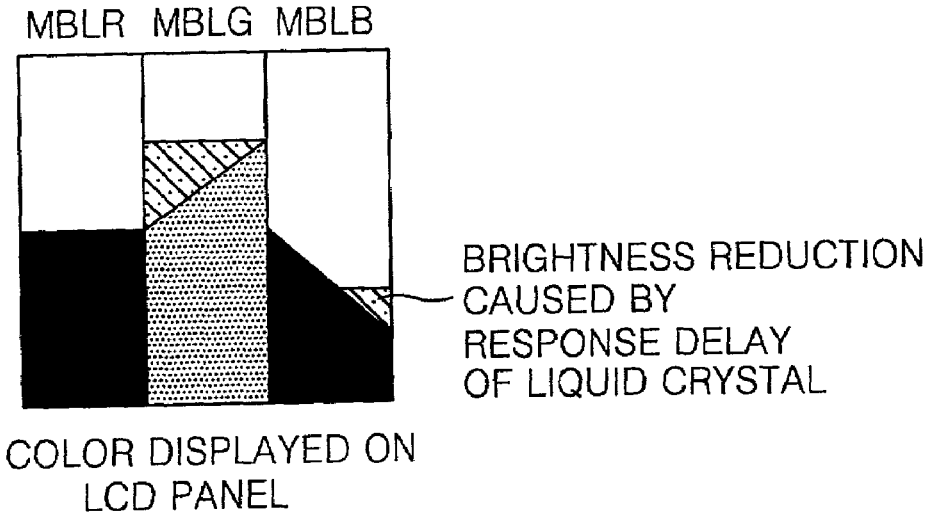
FIG.4B CONVENTIONAL ART
Figure 5:
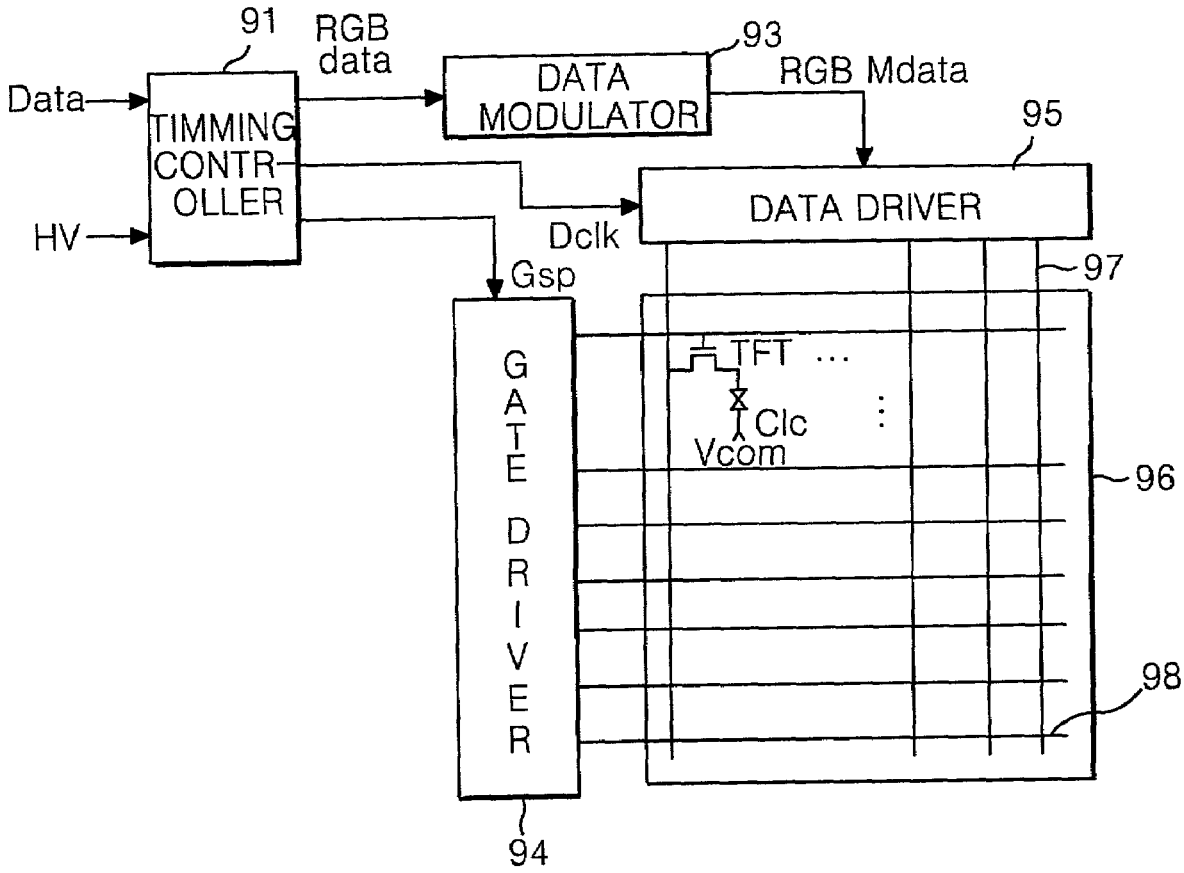
FIG. 5 is a block diagram showing a configuration of a liquid crystal display according to a first embodiment of the present invention.

A liquid crystal display (LCD) according to a first embodiment of the present invention is shown in FIG. 5.

The LCD includes a data driver 95 for supplying data to a plurality of data lines 97 of a liquid crystal display panel 96, a gate driver 94 for applying a scanning pulse to a plurality of gate lines 98 of the liquid crystal display panel 96, a timing controller 91 receiving digital video data and horizontal and vertical synchronizing signals H and V, and a data modulator 93 connected between the timing controller 91 and the data driver 95.

More specifically, the liquid crystal display panel 96 has a liquid crystal between two glass substrates, and has the data lines 97 thereon and the gate lines 98 provided on the lower glass substrate in such a manner to perpendicularly cross each other. A thin film transistor (TFT) provided at each intersection between the data lines 97 and the gate lines 98 responds to the scanning pulse to selectively supply data from the data line 97 to a liquid crystal cell Clc. To this end, a gate electrode of the TFT is connected to the gate line 98 while a source electrode thereof is connected to the data line 97. A drain electrode of the TFT is connected to a pixel electrode of the liquid crystal cell Clc.

The timing controller 91 outputs digital video data received from a digital video card (not shown) to the data modulator 93. Further, the timing controller 91 generates a dot clock Dclk and a gate start pulse GSP using the horizontal and vertical synchronizing signals H and V from the digital video card, thereby controlling the data driver 95 and the gate driver 94. The dot clock Dclk is applied to the data driver 95 while the gate start pulse GSP is applied to the gate driver 94.

The gate driver 94 includes a shift register (not shown) for sequentially generating a scanning pulse, that is, a gate high pulse in response to the gate start pulse GSP applied from the timing controller 91, and a level shifter (not shown) for shifting a voltage of the scanning pulse into a level suitable for driving the liquid crystal cell Clc. The TFT is turned on in response to the scanning pulse from the gate driver 94 to apply video data through the data line 97 to the pixel electrode of the liquid crystal cell Clc.

The data driver 95 receives red (R), green (G), and blue (B) modulated data RGB Mdata modulated by the data modulator 93 and receives the dot clock Dclk from the timing controller 91. The data driver 95 latches the red (R), green (G), and blue (B) modulated data RGB Mdata in synchronization with the dot clock Dclk and thereafter converts the latched data into analog data, to apply to the data lines 97 line by line. The data driver 95 may further apply a gamma voltage corresponding to the modulated data to the data line 97.

The data modulator 93 modulates the RGB data using a look-up table that contains modulation information for modulating data as provided by equations (4) to (6) (to be discussed in detail later). Accordingly, the data modulator 93 modulates data voltages of the sub-cells having data changes to be larger or smaller. Moreover, the data modulator 93 modulates the data voltages of the sub-cells without a data change to be smaller, thereby balancing red (R), green (G), and blue (B) colors.

Figure 6:
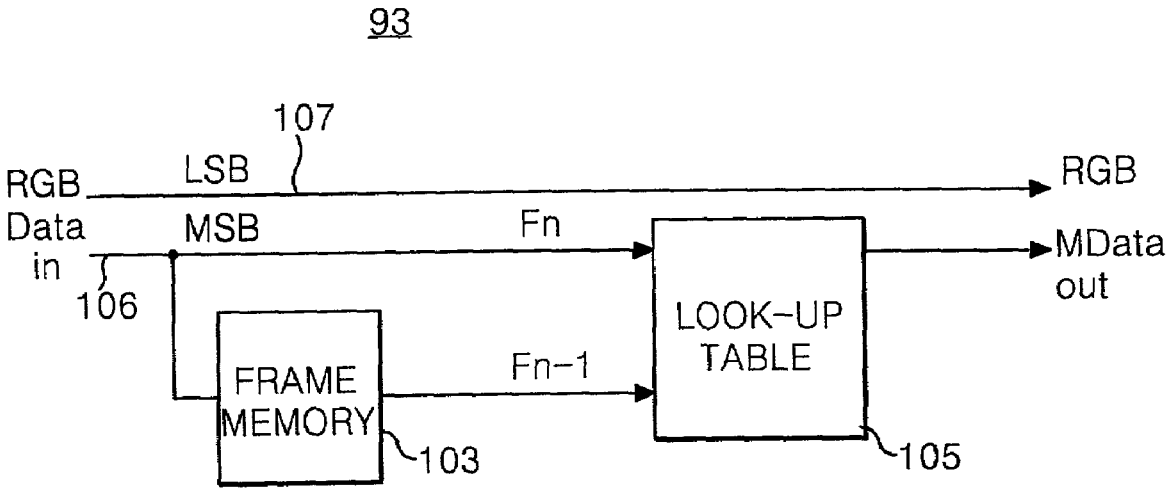
FIG. 6 is a detailed block diagram of a data modulator shown in FIG. 5.

Referring to FIG. 6, the data modulator 93 includes a frame memory 103 connected to a most significant bus line 106 of the timing controller 91, and a look-up table 105 connected to both the most significant bit bus line 106 and an output terminal of the frame memory 103.

The frame memory 103 stores most significant bits supplied from the timing controller 91 during one frame interval and outputs the stored data to the look-up table 105 every frame. If 8-bit data RGB Data are outputted from the timing controller 91, the frame memory 103 stores most significant 3 or 4 bits MSB of the 8-bit data RGB Data.

The look-up table 105 modulates data of the current frame Fn by using the data of the current frame Fn from the most significant bit bus line 106 and data of the previous frame Fn−1 from the frame memory 103 as an index to map the modulated data into a look-up table such as the following table:

TABLE 2

| | 3 V | 4 V | 5 V | 6 V | 7 V | 8 V |
|---|---|---|---|---|---|---|
| 3 V | ≦2.9 V | 5.1 V | 9.3 V | 11.8 V | 13.7 V | 15.4 V |
| 4 V | 2.2 V | ≦3.9 V | 6.8 V | 9.1 V | 11.2 V | 12.9 V |
| 5 V | 2.0 V | 3.2 V | ≦4.9 V | 7.3 V | 9.3 V | 11.1 V |
| 6 V | 1.65 V | 2.6 V | 4.0 V | ≦5.9 V | 8.0 V | 9.8 V |
| 7 V | 1.6 V | 2.6 V | 3.5 V | 4.9 V | ≦6.9 V | 8.8 V |
| 8 V | 1.6 V | 2.4 V | 3.1 V | 4.4 V | 6.2 V | ≦7.9 V |

In the above table, the furthermost left column represents a data voltage VDn−1 of the previous frame Fn−1 and the uppermost row is a data voltage VDn of the current frame Fn.

In the LCD according to the present invention, only information in the look-up table 105 is changed in the high-speed driving method, so that an additional hardware may not be necessary.

The look-up table information of Table 2 is experimentally determined to balance red (R), green (G), and blue (B) colors, and the values are not limited to Table 2, but may be modified in the range that satisfies the following equations:

$$VDn<VDn-1 \rightarrow MVDn<VDn \quad (4)$$

$$VDn=VDn-1 \rightarrow MVDn<VDn \quad (5)$$

$$VDn>VDn-1 \rightarrow MVDn>VDn \quad (6)$$

Figure 7A:
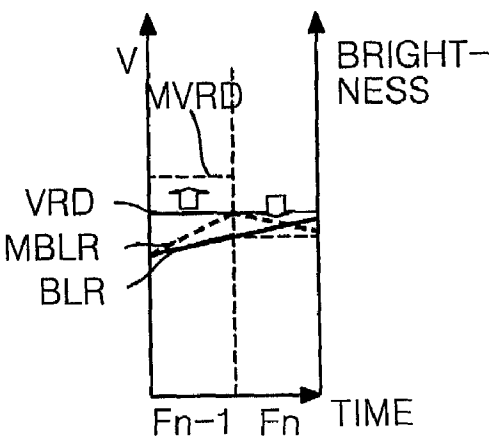
FIGS. 7A to 7C illustrate brightness variations for red, green, and blue in a color-correction method for the liquid crystal display according to the present invention.
Figure 7B:
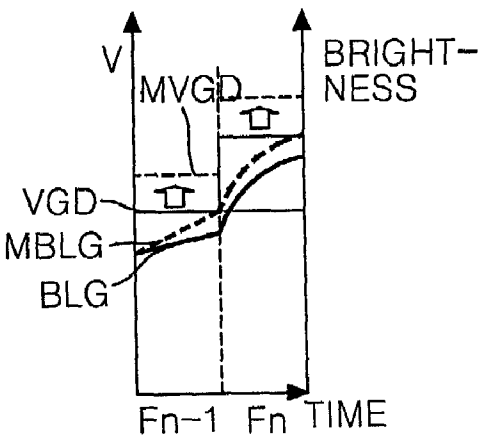
Figure 7C:
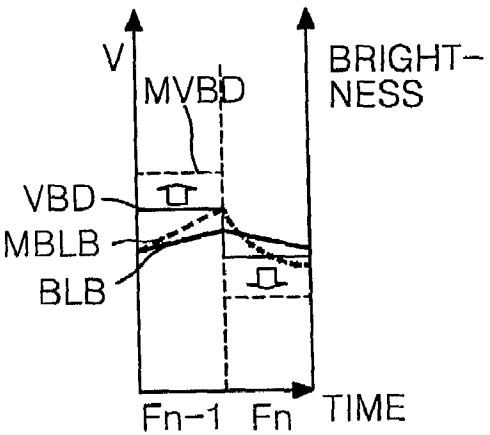
Figure 8A:
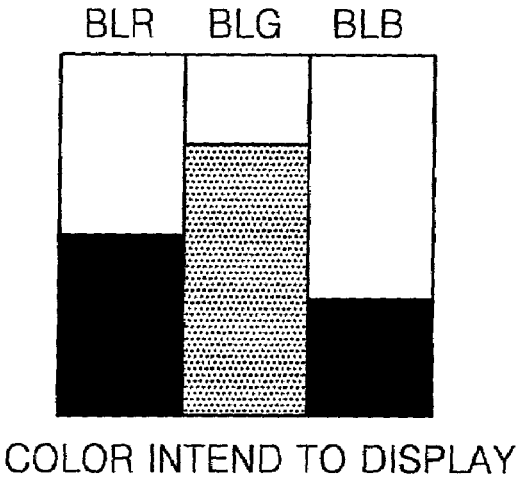
FIGS. 8A and 8B are schematic diagrams comparing colors intended to display with the colors displayed on a liquid crystal display panel in the color-correction method for the liquid crystal display according to the present invention.
Figure 8B:
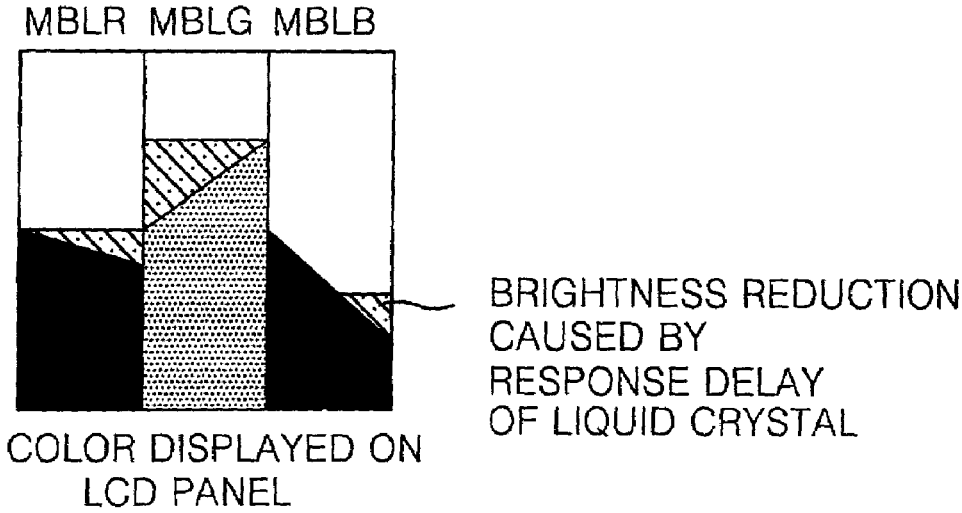

The LCD according to the present invention may achieve a better color balance even when none of the R, G, and B color data are changed. An example may be illustrated when green data VGD inputted at the current frame Fn has an increased voltage level greater than the previous frame Fn−1, they are modulated to be greater than the input data. When blue data VBD has a reduced voltage level smaller than the previous frame Fn−1, they are modulated to be smaller, as shown in FIG. 7B. In this case, red data VRD are inputted to the current frame Fn similar to the previous frame Fn−1. However, its voltage level is modulated to be smaller by the first look-up table 64 and is much more modulated to be smaller upon passing through the second look-up table 65. Accordingly, as shown in FIGS. 8A and 8B, brightness BLG and BLB of the green and blue sub-cells are lowered by the oblique line portions in FIG. 8B due to a slow response characteristic of the liquid crystal and brightness BLR of the red sub-cell is also lowered by the oblique line portion due to the same reason. Thus, a high-speed driving scheme is realized and R, G, and B colors are properly balanced in accordance with the data modulation.

Figure 9:
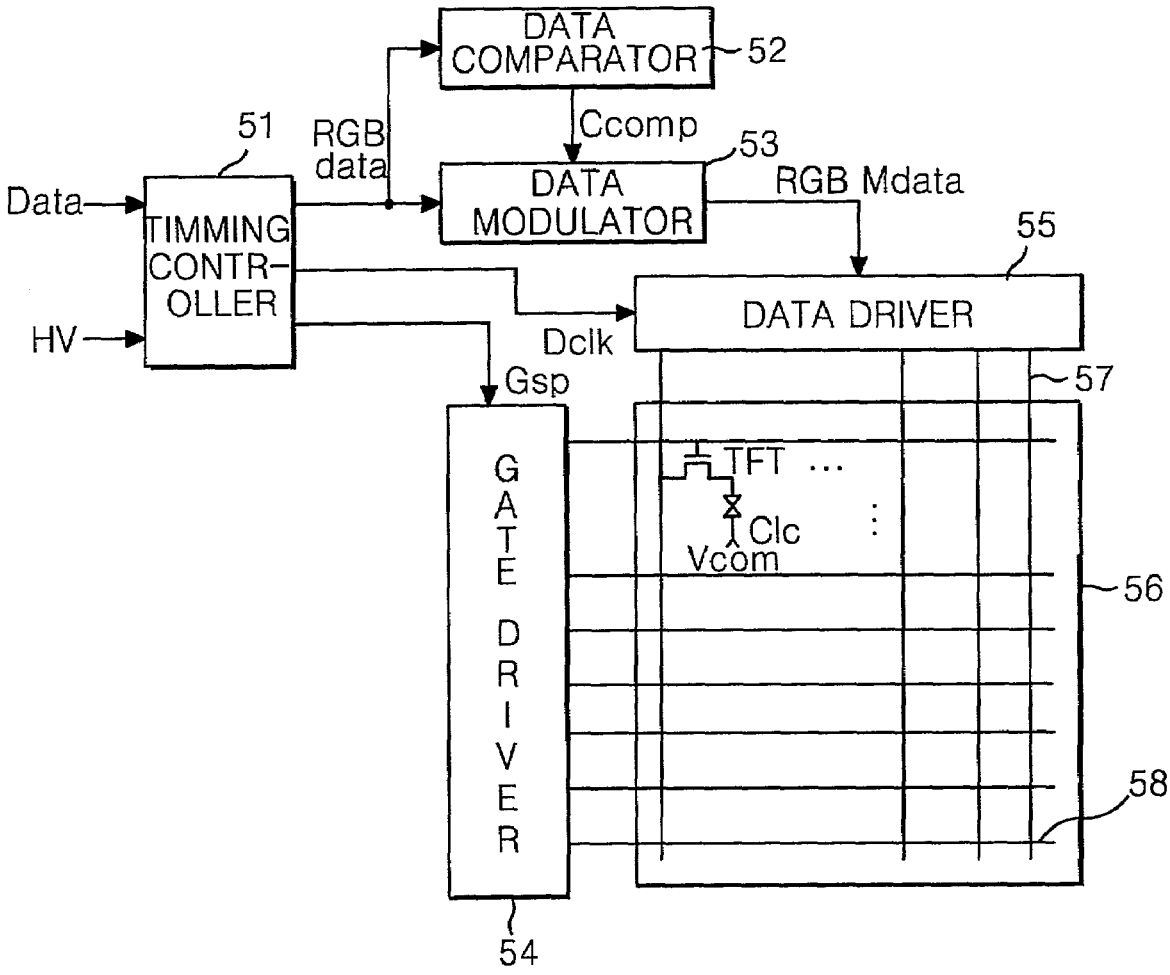
FIG. 9 is a block diagram showing a configuration of a liquid crystal display according to a second embodiment of the present invention.
Figure 10:
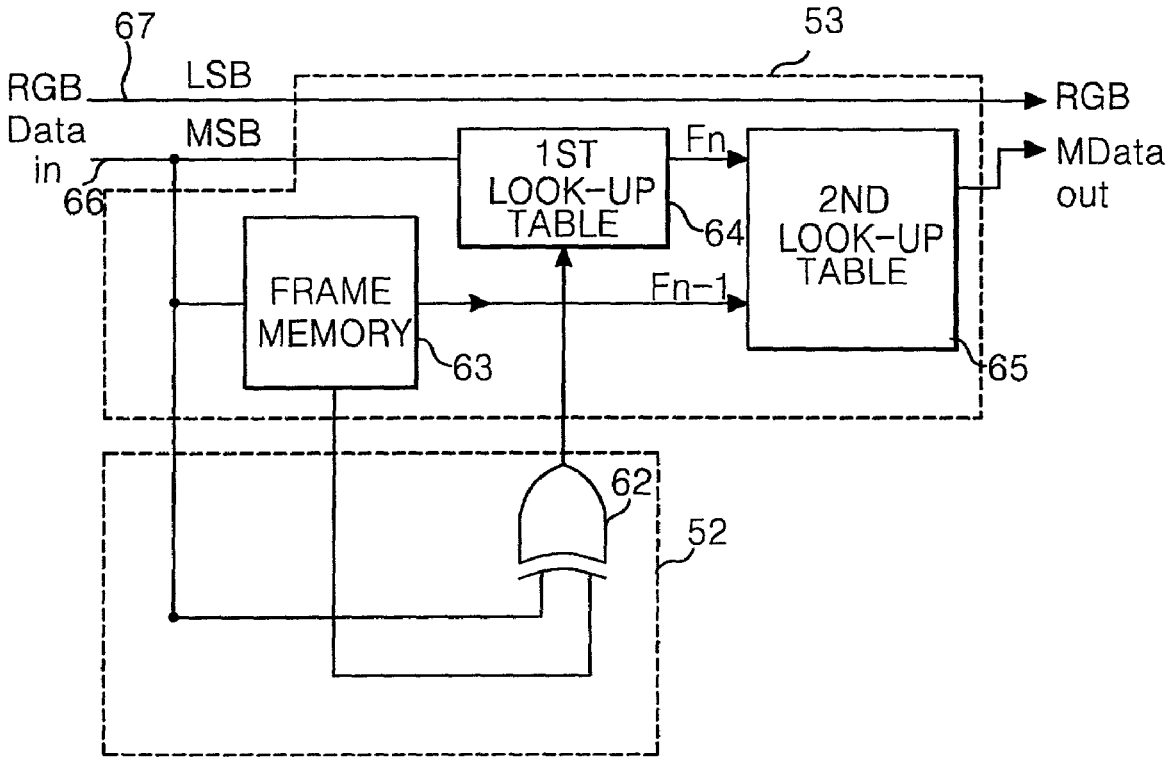
FIG. 10 is a detailed block diagram of a data comparator and a data modulator shown in FIG. 9.

FIG. 9 and FIG. 10 illustrate a liquid crystal display (LCD) according to a second embodiment of the present invention.

Referring to FIG. 9, an LCD includes a liquid crystal display panel 56 having a plurality of data lines 57 and gate lines 58 crossing each other and thin film transistors (TFT's) arranged at intersections between the data lines 57 and the gate lines 58 to drive liquid crystal cells Clc, a data driver 55 for supplying data to the data lines 57 of a liquid crystal display panel 56, a gate driver 54 for applying a scanning pulse to the gate lines 58 of the liquid crystal display panel 56, a timing controller 51 receives digital video data and horizontal and vertical synchronizing signals H and V, and a data comparator 52 and a data modulator 53 connected between the timing controller 51 and the data driver 55.

More specifically, the liquid crystal display panel 56 has a liquid crystal between two glass substrates, and has the data lines 57 and the gate lines 58 provided on the lower glass substrate in such a manner to perpendicularly cross each other. The TFT provided at each intersection between the data lines 57 and the gate lines 58 responds to a scanning pulse to selectively supply data from the data line 57 to a liquid crystal cell Clc. To this end, a gate electrode of the TFT is connected to the gate line 58 while a source electrode thereof is connected to the data line 57. A drain electrode of the TFT is connected to a pixel electrode of the liquid crystal cell Clc.

The timing controller 51 commonly applies digital video data supplied from a digital video card (not shown) to the data comparator 52 and the data modulator 53. Further, the timing controller 51 generates a dot clock Dclk and a gate start pulse GSP using horizontal and vertical synchronizing signals H and V from the digital video card, thereby controlling the data driver 55 and the gate driver 54. The dot clock Dclk is applied to the data driver 55 while the gate start pulse GSP is applied to the gate driver 54.

The gate driver 54 includes a shift register (not shown) for sequentially generating a scanning pulse, that is, a gate high pulse in response to the gate start pulse GSP applied from the timing controller 51, and a level shifter (not shown) for shifting a voltage of the scanning pulse into a level suitable for driving the liquid crystal cell Clc. The TFT is turned on in response to the scanning pulse from the gate driver 54 to apply the video data through the data line 57 to the pixel electrode of the liquid crystal cell Clc.

The data driver 55 is supplied with red (R), green (G), and blue (B) modulated data RGB Mdata modulated by the data modulator 53 and receives a dot clock Dclk from the timing controller 51. The data driver 55 latches the red (R), green (G), and blue (B) modulated data RGB Mdata in synchronization with the dot clock Dclk and thereafter converts the latched data into analog data, to apply to the data lines 57 line by line. Further, the data driver 55 may apply a gamma voltage corresponding to the modulated data to the data line 97.

The data comparator 52 compares data of the previous frame Fn−1 with data of the current frame Fn at the same cell to detect a data change. The detected compared information Ccomp is inputted to the data modulator 53.

The data modulator 53 compares data of the previous frame Fn−1 with data of the current frame Fn at the same cell and modulates using a look-up table, in which the modulated data is registered, in accordance with the compared result. The data modulator 53 modulates more data in which a voltage level of the current frame Fn is larger than that of the previous frame Fn−1. Conversely, the data modulator 53 modulates less data in which a voltage level of the current frame Fn is smaller than that of the previous frame Fn−1. Further, the data comparator 52 and the data modulator 53 modulates data, in which a voltage level of the previous frame Fn−1 becomes equal to that of the current frame Fn, at a lower value, thereby correcting a distorted color balance caused by a sub-cell with no data change.

FIG. 10 is a detailed block diagram of the data comparator 52 and the data modulator 53.

As shown in FIG. 10, the data comparator 52 includes an exclusive logical sum gate 62 (hereinafter, referred to as "XOR") connected to a most significant bit bus line 66.

The XOR 62 executes an exclusive logical sum operation of most significant bit data of the current frame Fn from the most significant bit bus line 66 of the timing controller 51 and most significant bit data of the previous frame Fn−1 from the first frame memory 61. Thus, the XOR 62 generates a high logic '1' when most significant bit data of the previous frame Fn−1 are different from those of the current frame Fn while generating a low logic '0' when most significant bit data of the previous frame Fn−1 are identical to those of the current frame Fn. An output signal, that is, the compared information Ccomp of the XOR 62 is inputted to the data modulator 53.

The data modulator 53 includes a frame memory 63 connected to the most significant bit bus line 66 of the timing controller 51, a first look-up table 64 connected to both the most significant bus line 66 and the XOR 62, and a second look-up table 65 connected to both an output terminal of the frame memory 63 and an output terminal of the first look-up table 64.

The second frame memory 63 stores most significant bit data supplied from the timing controller 51 during one frame interval and applies the stored data to the second look-up table every frame. If 8-bit data RGB Data are inputted from the timing controller 51, the frame memory 63 stores most significant 3 or 4 bits of the data.

The first look-up table 64 modulates data, in which a value of the previous frame Fn−1 is identical to that of the current frame Fn, at a lower value using data of the current frame Fn from the most significant bit bus line 66 and the compared information Ccomp from the XOR 62 as an index. Such a first look-up table 64 is registered with modulation information as shown in the following table:

TABLE 3

| | 3 V | 4 V | 5 V | 6 V | 7 V | 8 V |
|---|---|---|---|---|---|---|
| 0 | ≦2.9 V | ≦3.9 V | ≦4.9 V | ≦5.9 V | ≦6.9 V | ≦7.9 V |
| 1 | 3 V | 4 V | 5 V | 6 V | 7 V | 8 V |

In the above table, the furthermost left column represents a logical value of the compared information Ccomp, and the uppermost row is a most significant bit data voltage of the current frame Fn inputted from the most significant bit bus line 66.

As shown from the above Table 3, the first look-up table 64 modulates a data voltage of the current frame Fn to have a lower value when the data voltage value of the previous frame Fn−1 is equal to that of the current frame Fn. On the other hand, the first look-up table 64 does not modulate the data voltage of the current frame Fn when the data voltage of the current frame Fn is different from that of the previous frame Fn−1.

The modulation information of the first look-up table 64 in Table 3 is experimentally determined to balance R, G, and B colors based on the modulation information of the second look-up-table 65.

The second look-up table 65 modulates a data voltage when the data voltage of the current frame Fn is different from that of the previous frame Fn−1, as shown in Table 1, using the data of the current frame Fn from the first look-up table 64 and the data of the previous frame Fn−1 from the frame memory 63 as an index. In other words, the second look-up table 65 modulates the data voltage of the current frame Fn to have a larger value when the data voltage of the current frame Fn is larger than that of the previous frame Fn−1. Conversely, the second look-up table 65 modulates the data voltage of the current frame Fn to have a smaller value when the data voltage of the current frame Fn is smaller than that of the previous frame Fn−1. The most significant bit data MSB, along with the least significant bit data LSB, is applied to the data driver as modulated data RGB Mdata.

As a result, a data modulating method according to the first and second look-up tables 64 and 65 may be expressed as the above equations (4) to (6).

In the mean time, in the color-correction method and the apparatus for a liquid crystal display according to the present invention, only the most significant bit data MSB are modulated to reduce the size of the look-up table. Alternatively, although the size of look-up table is minutely increased, both the most significant bit data MSB and the least significant bit data LSB may be modulated.

As described above, according to the present invention, a voltage charged in the liquid crystal cell is modulated for a high-speed driving. Also, unchanged data may be modulated based on a modulated amount of the changed data, thereby balancing colors.

The data comparator and the data modulator shown in FIG. 5 and FIG. 9 may be installed at the earlier stage of the timing controller to modulate data inputted to the timing controller. Also, the data modulator may be implemented by other means, such as a program including an algorithm for modulating data and a microprocessor for carrying out this program, in accordance with the conditions of the above-mentioned equations (4) to (6) rather than a look-up table in the present invention.

It will be apparent to those skilled in the art that various modifications and variations can be made in the color-correction method and the apparatus for a liquid crystal display of the present invention without departing from the spirit or scope of the inventions. Thus, it is intended that the present invention covers the modifications and variations of this invention provided they come within the scope of the appended claims and their equivalents.

What is claimed is:

1. A color-correction method for a liquid crystal display, comprising:

comparing a data voltage of a current frame and a data voltage of a previous frame;

increasing the data voltage of a current frame if the data voltage of the current frame is greater than the data voltage of the previous frame;

decreasing the data voltage of the current frame if the data voltage of the current frame is smaller than the data voltage of the previous frame; and decreasing the data voltage of the current frame with a predetermined value for correcting a color balance if the data voltage of the current frame is equal to the data voltage of the previous frame.

2. The method according to claim 1, wherein the increased data voltage of the current frame is proportionally increased with respect to a difference between the current data voltage and the previous data voltage.

3. The color-correction method according to claim 1, wherein the data voltage includes most significant bit data.

4. The method according to claim 1, wherein the data voltage includes both most significant bit data and least significant bit data.

5. A color-correction method for a liquid crystal display, comprising:

comparing a data voltage of a current frame and a data voltage of a previous frame;

decreasing the data voltage of the current frame with a predetermined value for correcting a color balance if the data voltage of the current frame is equal to that of the previous frame; and increasing the increased data voltage of the current frame if the data voltage of the current frame is greater than the data voltage of the previous frame, and decreasing the decreased data voltage of the current frame if the data voltage of the current frame is smaller than the data voltage of the previous frame.

6. The method according to claim 5, wherein the data voltage includes most significant bit data.

7. The method according to claim 5, wherein the data voltage includes both most significant bit data and least significant bit data.

8. A color-correction apparatus for a liquid crystal display, comprising:

a frame memory delaying data for one frame interval; and a data modulator modulating the data from the frame memory using a look-up table having modulation information for increasing a data voltage of a current frame if the data voltage of the cunent frame is greater than that a data voltage of a previous frame, and decreasing the data voltage of the current frame if the data voltage of the current frame is smaller than the data voltage of the previous frame, and decreasing the data voltage of the current frame with a predetermined value for correcting a color balance if the data voltage of the current frame is equal to the data voltage of the previous frame.

9. The color-correction apparatus according to claim 8, further comprising, a liquid crystal display panel displaying modulated data by the data modulator;

a timing controller outputting input data to the frame memory and the data modulator;

a data driver applying the modulated data to the liquid crystal display panel under control of the timing controller, and a gate driver selecting a scanning line of the liquid crystal display panel to be supplied with the modulated data.

10. A color-correction apparatus for a liquid crystal display, comprising:

a data comparator determining whether input data are changed between a previous frame and a current frame;

a first data modulator more increasing a voltage level of the input data when the voltage is more increased at the current frame than at the previous frame and more decreasing the voltage level when the voltage level is more reduced at the current frame than at the previous frame; and a second data modulator decreasing the voltage with a predetermined voltage value for correcting a color when the voltage of the current frame is equal to the voltage of the previous frame.

11. The color-correction apparatus according to claim 10, further comprising, a liquid crystal display panel displaying modulated data by the first and second data modulators;

a timing controller outputting input data to the data comparator and the first and second data modulators;

a data driver applying the modulated data to a data line of the liquid crystal display panel under control of the timing controller; and a gate driver selecting a scanning line of the liquid crystal display panel supplied with the modulated data under control of the timing controller.

12. The color-correction apparatus according to claim 10, wherein the data comparator includes an exclusive logical sum operator executing an exclusive logical sum operation of delayed data and current input data.

13. The color-correction apparatus according to claim 10, wherein the first modulator includes:

a frame memory delaying the input data for one frame interval; and a look-up table registered with modulation information for increasing a voltage level of the input data when the voltage level is more increased at the current frame than at the previous frame and decreasing the voltage of the input data when the voltage level is more reduced at the current frame than at the previous frame.

14. The color-correction apparatus according to claim 10, wherein the second modulator includes a look-up table registered with modulation information for reducing the voltage level when the voltage level of the current frame is equal to the voltage level of the previous frame based on information from the data comparator.

* * * * *